US012559696B2

(12) United States Patent
Hitchcock

(10) Patent No.: US 12,559,696 B2
(45) Date of Patent: Feb. 24, 2026

(54) AMINE CONTAINING AQUEOUS FLUIDS AND METHOD OF PRODUCING SAME

(71) Applicant: Illinois Tool Works Inc., Glenview, IL (US)

(72) Inventor: Leroy Nelson Hitchcock, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 18/663,169

(22) Filed: May 14, 2024

(65) Prior Publication Data

US 2024/0384199 A1 Nov. 21, 2024

Related U.S. Application Data

(60) Provisional application No. 63/467,109, filed on May 17, 2023.

(51) Int. Cl.

| | |
|---|---|
| ***C10M 173/02*** | (2006.01) |
| ***C10M 133/08*** | (2006.01) |
| ***C10M 145/16*** | (2006.01) |
| *C10N 30/12* | (2006.01) |
| *C10N 40/20* | (2006.01) |
| *C10N 40/22* | (2006.01) |

(52) U.S. Cl.

CPC ..... *C10M 173/02* (2013.01); *C10M 133/08* (2013.01); *C10M 145/16* (2013.01); *C10M 2209/06* (2013.01); *C10M 2215/042* (2013.01); *C10N 2030/12* (2013.01); *C10N 2040/22* (2013.01); *C10N 2040/245* (2020.05)

(58) Field of Classification Search

CPC ..... C10N 2020/04; C10N 2030/12; C10N 2040/22; C10N 2040/245; C10M 173/02; C10M 145/16; C10M 133/08; C10M 2207/127; C10M 2207/284; C10M 2209/06; C10M 2207/126; C10M 2215/042; C10M 2209/084; C10M 19/044; C10M 2219/104; C10M 2209/104; C10M 2209/105

See application file for complete search history.

(56) References Cited

U.S. PATENT DOCUMENTS

| | | | | |
|---|---|---|---|---|
| 2007/0298983 | A1* | 12/2007 | Theunissen | C10M 173/00 252/396 |
| 2020/0325414 | A1* | 10/2020 | Hardt | C10M 173/02 |
| 2022/0119731 | A1* | 4/2022 | Hudson | C10M 173/02 |

* cited by examiner

*Primary Examiner* — Vishal V Vasisth
(74) *Attorney, Agent, or Firm* — MaxGoLaw PLLC

(57) ABSTRACT

An aqueous solution is provided that includes an alkylated amine having an amine group and present from 6 to 40 total weight percent. A polyacid having carboxylic groups of a $C_5$-$C_{14}$ dicarboxylic acid, a polymeric acid having a plurality of acid groups, or a combination thereof is also present in the solution so as to result in a ratio of acid groups to amine group equivalents of at least 1.8:1. An aqueous solution is also provided in which the alkylated amine is 3-amino-4-octanol. The solutions provided have extended operating lifetimes relative to microbial growth, reduce staining of contacting metal substrates, or both. Some alkylated amines are soluble beyond aqueous solubility limits through the inclusion of the polyacids. A method of metalworking includes exposing a metal substrate to the aqueous solution. Followed by removing or displacing a portion of the metal substrate.

13 Claims, 2 Drawing Sheets

AMINE CONTAINING AQUEOUS FLUIDS AND METHOD OF PRODUCING SAME

RELATED APPLICATIONS

This application is a non-provisional application that claims priority benefit of U.S. Provisional Application Ser. No. 63/467,109 filed May 17, 2023; the contents of which are incorporated herein by reference.

FIELD OF THE INVENTION

The present disclosure relates to amine containing fluids, and specifically to metalworking fluids and cooling tower inhibitors formed therewith in combination with organic acids.

BACKGROUND OF THE INVENTION

Metalworking fluids are comprised of a range of engineered oils and other liquids that are used to optimize the metalworking process. Typically, metalworking fluids (MWF) are used to aid the cutting, grinding, or forming of metal and to provide good finish and workpiece quality while extending the life of the machine tools. The fluids cool and lubricate the metal-tool interface while aiding in the removal of fine particles or chips of metal away from the work-piece. The fluid can also provide adequate temporary indoor rust protection to the workpiece while in-process or prior to assembly. A spent or inadequate metalworking fluid results in spotting or other forms of surface degradation that can render machined components unusable for an intended purpose. Low redox potential metals such as aluminum, magnesium, and alloys containing these metals are particularly vulnerable to surface corrosion. Water-based fluids can be configured to resist the growth of microorganisms and/or the development of objectionable odors.

Cooling tower inhibitors are also required to also inhibit corrosion and scale with a greater emphasis on suppression of microbial growth. Microbial growth in cooling towers is a major source of respiratory disease outbreaks, such as those caused by *Legionella pneumophila*.

Amines and amino alcohols are widely used in water-dilutable fluids to neutralize acid-functional components and develop and maintain pH. This approach is met with limited success owing to the finite solubility of these amines in commercially viable cutting fluids and cooling tower solutions. Furthermore, in some settings, the odor of amines or amine alcohols that at higher concentrations would otherwise afford benefits disfavor such usage.

Continuing regulatory pressures on historical usage of antimicrobials suggests that fewer active antimicrobial ingredients will be available in the future and reduced concentrations of those still in use will be curtailed. Some amino alcohols have been hypothesized to increase permeability of a bacterial cell membrane so as to render any antimicrobials present more effective.

Accordingly, there remains a need for fluids that contain higher concentrations of amines or amino alcohols. Additionally, there is a need for environmentally friendly metalworking fluids and cooling tower inhibitors.

SUMMARY OF THE INVENTION

An aqueous solution is provided that includes an alkylated amine having an amine group and present from 6 to 40 total weight percent. A polyacid having carboxylic groups of: a $C_5$-$C_{14}$ dicarboxylic acid, a polymeric acid having a plurality of acid groups, or a combination thereof is also present in the solution so as to result in a ratio of acid groups to amine group equivalents of at least 1.8:1. An aqueous solution is also provided in which the alkylated amine is 3-amino-4-octanol.

The solutions provided have extended operating lifetimes relative to microbial growth, reduce staining of contacting metal substrates, or both. Some alkylated amines are soluble beyond aqueous solubility limits through the inclusion of the polyacids.

A method of metalworking includes exposing a metal substrate to the aqueous solution. Followed by removing or displacing a portion of the metal substrate.

BRIEF DESCRIPTION OF THE FIGURES

For a better understanding of the present invention, with regard to the embodiments thereof, reference is made to the accompanying examples and figures, in which.

DESCRIPTION OF THE INVENTION

Figure 1:
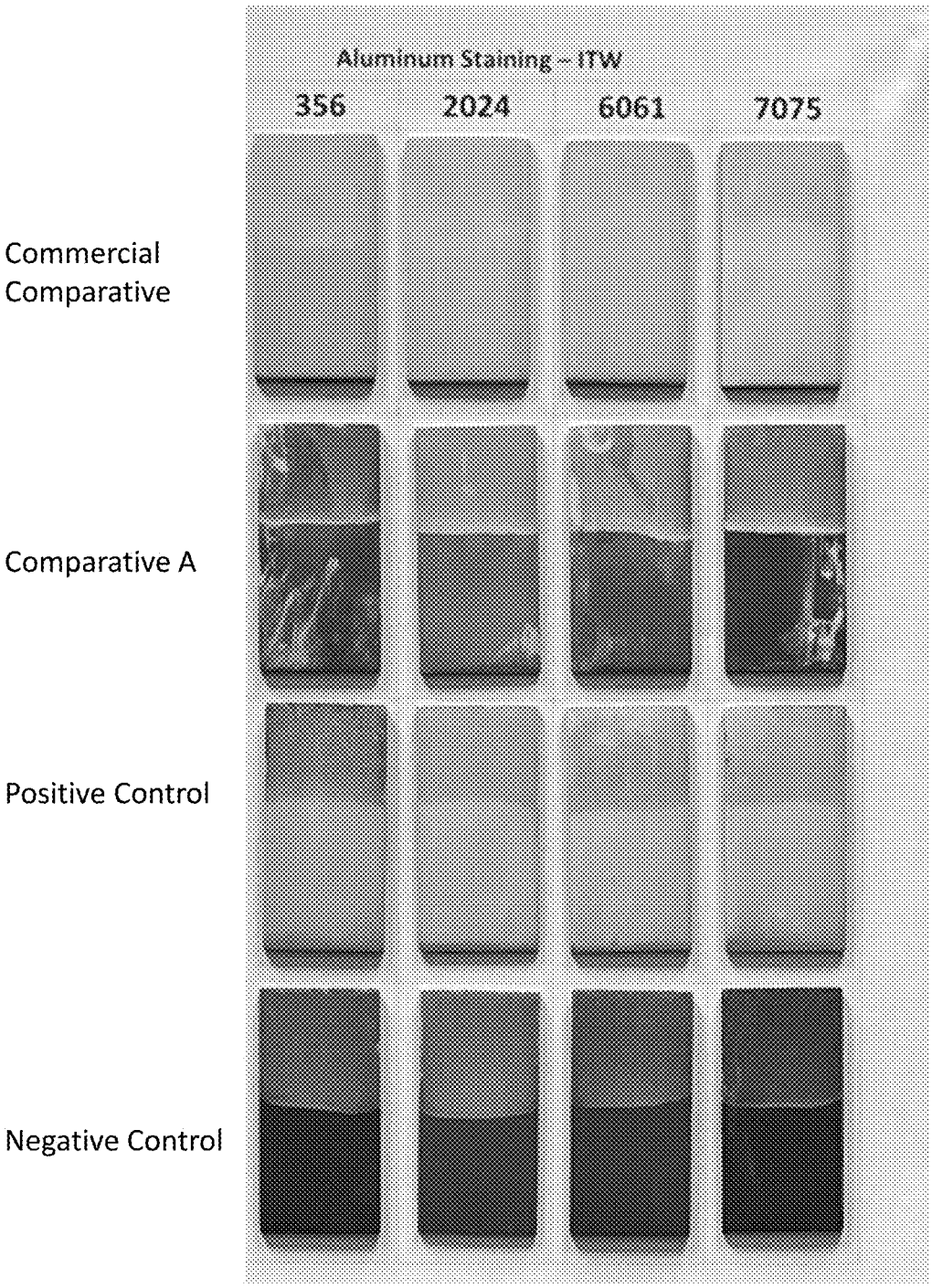
FIG. 1 are photographs depicting four types of aluminum panels exposed to various solutions to show the resulting metal staining.

The present invention has utility as a metalworking fluid or cooling tower fluid through the enhanced properties of amines in aqueous solutions through the inclusion of $C_6$-$C_{14}$ diacids or polyacids. In various inventive embodiments, alkyl amine concentrations exceed solubility limits, antimicrobial properties are enhanced, metal staining is inhibited, or a combination thereof. Extending working life of the resulting solutions results.

Water-based solutions of the present invention provide heat transfer, lubrication, and corrosion inhibition to surround metals. These properties tend to decrease for a number of reasons.

These fluids are used in difficult and extreme conditions and will naturally break down over time as a result. Additionally, they accumulate foreign substances, and experience environmental degradation associated with both thermal and microbial conditions. This need for monitoring and recharge/replacement adds to the operational expense of such solutions. The present invention, by extending the operational life of such solutions provide surprising improvements in the fields of metal working and cooling tower operation.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4,3-4, and 1-4.

"Combination" is inclusive of blends, mixtures, alloys, reaction products, and the like. Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention.

Unless indicated otherwise, explicitly or by context, the following terms are used herein as set forth below.

As used in the description of the invention and the appended claims, the singular forms "a," "an" and "the" are intended to include the plural forms as well, unless the context clearly indicates otherwise.

Also as used herein, "and/or" refers to and encompasses any and all possible combinations of one or more of the associated listed items, as well as the lack of combinations when interpreted in the alternative ("or").

An inventive aqueous solution is based on an alkylated amine present from 6 to 40 total weight percent that is combined with a polyacid of a $C_5$-$C_{14}$ dicarboxylic acid, a polymer having a plurality of acid groups, or a combination thereof. When the carboxylic groups are present in a molar ratio to amine groups of at least 1.8:1, surprising results are obtained in terms of performance. Specifically, the solubility of some limited water solubility alkylated amines is enhanced relative to solutions thereof absent the polyacid. In other inventive embodiments, a biocide present has an enhanced effect as evidenced by extended work life of the solution. In still other embodiments, pH stability is enhanced. In other inventive embodiments, the solution affords enhanced protection to contacting metal surfaces, The enhancements being relative to comparative solutions absent the polyacid. It is appreciated that inventive solutions can be formulated for a final use application or provided as a concentrate that is diluted just before usage.

An inventive solution includes at least one alkylated amine. The alkylated amine functions to neutralize acid-functional components, buffer pH, and active biocides, if present. Alkylated amines operative herein illustratively include monoethanolamine, diethanolamine, triethanolamine, monoisopropanolamine, 2-amino-2-methyl-1-propanol,-(diethylamino) ethanethiol, captamine, diethylethanolamine, methylcysteamine, 2-(tert-butylamino) ethanethiol, 2,2'-dimethoxy-1,1-dimethyl-dimethylamine, 3-amino-4-octanol, 3-butoxypropylamine, N-acetylcysteamine, homocysteamine, N,N-dimethylhydroxylamine, 2-(isopropylamino) ethanol, 2-(methylthioethyl) amine, 1-aminopropane-2-thiol, leucinol, cysteamine, N,O-dimethylhydroxylamine, and combinations thereof. The alkylated amine or combination of alkylated amines are present in an amount of total weight of from 6 to 40 total weight percent of the solution.

A polyacid is provided in the present invention to stabilize and otherwise modify the properties of the alkylated amine. Without intending to bound to a particular theory, it is believed that hydrogen bonding occurs between the single amine group of the alkylated amine and one of the acid groups of the polyacid so as to form a micellar structure that stabilizes the alkylated amine relative to water dissolution. The nature of the micellar structure is expected to be dependent on factors that include pH and the steric effects between the amine and diacid. K. Sakaioxylic et al. *Langmuir* 2012, 28, 51, 17617-17622. Hydrogen bonding prevents complexes from forming between amines and dicarboxylic acids. Tamada et anon. *Industrial & engineering chemistry research* 1990, 29.7, 1327-1333. Polyacids operative herein include $C_5$-$C_{14}$ dicarboxylic acids, and a polymeric acid, and a combination thereof with the proviso that the dicarboxylic acid and polymeric acid have some solubility in water. It is appreciated that the solubility of the polyacid is also potentially enhanced through resort to the present invention. $C_5$-$C_{14}$ dicarboxylic acids operative herein illustratively include hexanedioic acid, heptanedioic acid, octanedioic acid, 1,4-cyclohexanedicarboxylic acid, nonanedioic acid, decanedioic acid, undecanedioic acid, dodecanedioic acid, and combinations thereof. These examples are intended to include branched isomers of each of the aforementioned. Polymeric acids operative herein illustratively include polymers having multiple carboxylic acid, sulfonic acids, or boronic acid groups per polymer. Specific polymeric acids operative herein illustratively include polyacrylic acid, polymethacrylic acid, hyaluronic acid, polymethylpropane sulfonic acid, polystyrene sulfonic acid, poly (vinylbenzene boronic acid), or combinations thereof. Polymers with multiple acid groups have an acid group equivalent molecular weight of between 72 and 1,000 Daltons. The polyacid is provided in an amount such a ratio of acid groups to amine group equivalents of at least 1.8:1. In some embodiments, the ratio is between 1.9-2.4:1.

An inventive solution or diluted version thereof for usage has a neutral to basic pH to limit corrosion of contacting metal substrates. Typical pH values range from 7.0 to 10.5 and in other instance is between 7.2 and 9.8. It is appreciated that pH levels are initially modified with a pH modifying agent or added during usage to return the solution to the aforementioned pH range. pH modifying agents are limited only by compatibility with the other solution components and contacting metal substrates. pH modifying agents operative herein include NaOH, KOH, the aforementioned alkylated amines, and combinations thereof.

To prevent biological growth in an inventive solution, either in storage or during use thereof, biocides are often included. The addition of the biocide depends on the requirements of the application and can readily be determined by one skilled in the art. Biocides useful in the present invention illustratively include formaldehyde releasing chemicals, triazines, isothiazolin-3-ones, glutaraldehyde, O-phenylphenol, morpholine, quaternary ammonium and phosphonium salts, including the biocides described in catalogs such as "Industrial Biocides", 2005 (ISP). Specific biocides operative herein include hexahydro-1,3,5 tris (2-hydroxyethyl)-s-triazine; 1,2-benzisothiazolin-3-one, and combinations thereof. A biocide, if present, is commonly used in metalworking or cooling tower applications in amounts of 0.1 to 5 total weight percent. As noted herein, and without intending to be bound to a particular theory, alkylated amines are believed to increase permeability of the bacterial cell membranes thereby enabling the biocide to work more efficiently.

Corrosion inhibition is important for protecting metal substrate that are in contact with an inventive solution. Corrosion inhibitors operative herein include $C_6$-$C_{12}$ carboxylic acids of which isononanoic acid is exemplary; organically modified zinc aluminum molybdenum orthophosphate hydrate; zinc-5-nitroisophthalate; calcium borosilicate; a zinc salt of a benzoic acid; alkaline earth metal phosphate; zinc-barium phosphate; zinc phosphate; benzotriazol; tolytriazol; or combinations thereof. A corrosion inhibitor, if present, is included from 0 to 5 total weight percent of the inventive solution.

In some inventive embodiments, a lubricity additive is provided to facilitate metalworking or pumping. Lubricity additives operative herein include oils such as soybean oil, canola oil, sunflower oil, jatropha oil, palm oil, methyl ester of soybean oil, canola oil, jatropha oil or palm oil; graft copolymers such as acrylic acid grafted polyether, polyoxypropylene-polyoxyethylene and combinations thereof; polyalkylene glycols, such as ethylene glycol, propylene glycol, butylenes glycol, and hexylene glycol; sugar alcohols; polyvinyl alcohol; sulfonated polyvinylstyrene; poly (acrylic/styrene) copolymer; polyvinylpyrrolidone and its copolymers; polyoxazolines; and salts of polyamino carboxylic acid such as the sodium salt of polyaspartic acid. alkyl aryl sulfonate; fatty acid salts, such as neopentyl glycol dioleate, trimethylolpropane trioleate, pentaerythritol tetraoleate, propylene glycol dioleate, or ricinoleic acid condensate; alkoxylated fatty amines and alcohols; ether carboxylic acids and its salts, and lecithin phosphorus containing compounds, and combinations thereof, sulfur containing compounds, such as sulfonic acid ester of plant oils, and combinations thereof, or fatty acid compounds containing compounds, such as tall oil fatty acid. In some embodiments, an antifoaming agent is added to inhibit foaming that would interfere with functionality. A lubricity additive, if present, is included from 0 to 30total weight percent of the inventive solution.

A chelating agent is provided in some inventive embodiments. A chelating agent operative herein is selected to bind a target metal associated with a contacting metal substrate and illustratively includes ethylenediaminetetraacetic acid (EDTA), ethylenediamine-N,N'-disuccinic acid (EDDS), ethyleneglycol bis (2-aminoethylether)-N,N,N',N'-tetraacetic acid (EGTA), diethylenetriaminepentaacetic acid (DTPA), trans-1,2-diaminocyclohexane tetraacetic acid (CDTA), iminodisuccinate (IDS), nitrilotracetic acid (NTA), or any combination or mixture thereof. A chelating agent, if present, is included from 0 to 5 total weight percent of the inventive solution.

In some inventive embodiments, an anti-oxidant is present in an inventive solution. An antioxidant operative herein illustratively includes butylated hydroxyanisole, 2,6-di-ter-butyl cresol, 2,2'-methylene bis (6-t-butyl-4-methyl phenol), 2,2'-thio bis (6-t-butyl-4-methyl phenol), tert-butyl hydroquinone, di-tert-butyl hydroquinone, di-tert-amyl hydroquinone, methyl hydroquinone, p-methoxy phenol, tetrakis [methylene-3-(3',5'-di-tert-butyl-4'-hydroxyphenyl) propionate] methane, N-(2-aminoethyl)-3-[3,5-bis (tert-butyl)-4-hydroxyphenyl] propanamide, 5,7-di-tert-butyl-3-(3,4,-dimethylphenyl)-3H-benzofuran-2-one, dilauryl thiodipropionate, dimyristyl thiodipropionate, tris (nonylphenyl) phosphite, and combinations thereof. Typical loadings of an anti-oxidant in an inventive solution are from 0 to 12total weight percent of the solution.

In some inventive embodiments, a color-changing component is added to provide a visual indicator to a normal, unaided human eye when the pH of the solution is outside the optimal range and that maintenance is required. Color-changing components operative herein are detailed in co-owned U.S. Pat. No. 9,778,242. Addition of pH modifiers or other components may correct the solution pH, causing the solution to return it to an original color indicative of a suitable operating pH range.

Table 1 lists the major components of an inventive solution.

Metal substrates in the context of metalworking and cooling towers benefit from contact with an inventive solution through reduced spotting and microbial growth relative to conventional solutions absent the inventive combination. Metal substrates that benefit from the present invention include iron, steel alloys, aluminum, aluminum alloy, and magnesium alloys.

TABLE 1

Composition of inventive solutions.

| Ingredient | Typical Total Weight Percent | Preferred Total Weight Percent |
|---|---|---|
| Alkylated amine | 6-40 | 6-35 |
| Polyacid | Acid: amine ratio >1.8:1 | 1.9-2.4:1 |

TABLE 1-continued

Composition of inventive solutions.

| Ingredient | Typical Total Weight Percent | Preferred Total Weight Percent |
|---|---|---|
| pH modifying agent | to pH 7-10.5 | to pH 7.2-9.8 |
| Biocide | 0.1-5 | 0.5-2.0 |
| Corrosion inhibitors | 0-25 | 5-20 |
| Lubricity additive | 0-30 | 1-15 |
| Chelating agent | 0-5 | 0.5-2.0 |
| Antioxidant | 0-12 | 0.5-1 |
| Color-changing component | 0-2 | 0.1-2.0 |
| Water | Remainder | Remainder |

The present disclosure is now illustrated by reference to the following example. Unless otherwise specified, all parts, percentages and ratios are on a weight basis.

EXAMPLES

Comparative Example A

A solution is prepared with 14.5 total weight percent of triethanolamine, 15.0 total weight percent of amine neutralized, mixed dibasic and mono-carboxylic acids, 2.5 total weight percent of 3-amino-4-octanol, 4.5 total weight percent of isononanoic acid, 10.0 total weight percent of polyoxypropylene-polyoxyethylene block copolymer with average molecular weight, 2,150, 1.5total weight percent of 1,2-benzisothiazolin-3-one, 1.0 total weight percent of EDTA and the remainder being water.

Example 1

The amine neutralized, mixed dibasic and mono-carboxylic acids of Comparative Example A is replaced with a like amount of octanedioic acid (suberic acid).

Example 2

Test strips of aluminum alloys 357, 2024, 6061, and 7075 are corrosion tested in accordance with ASTM B117 that have been exposed to a various solution. These results are shown in FIG. 1 for a commercially available metal working fluid (first row), Comparative Example A (second row), a positive control (third row), and a negative control (fourth row). The commercially available metal working fluid and Comparative Example A both failed. This testing is repeated with Example 1 and passed with an appearance similar to the positive control.

Comparative Example B

A solution is prepared with 20.0 total weight percent of triethanolamine, 20.0 total weight percent of sulfonic acid ester of plant oils, 0.5 total weight percent of sodium benzoate, 5.0 total weight percent of isononanoic acid, 12.0 total weight percent of acrylic acid grafted polyether, 1.5total weight percent of 1,2-benzisothiazolin-3-one, 1.0 total weight percent of EDTA and the remainder being water.

Example 3

Decanedioic acid is added to yield an acid group to amine stoichiometry of 1.9:1 with a commensurate reduction in water.

Example 4

Figure 2:
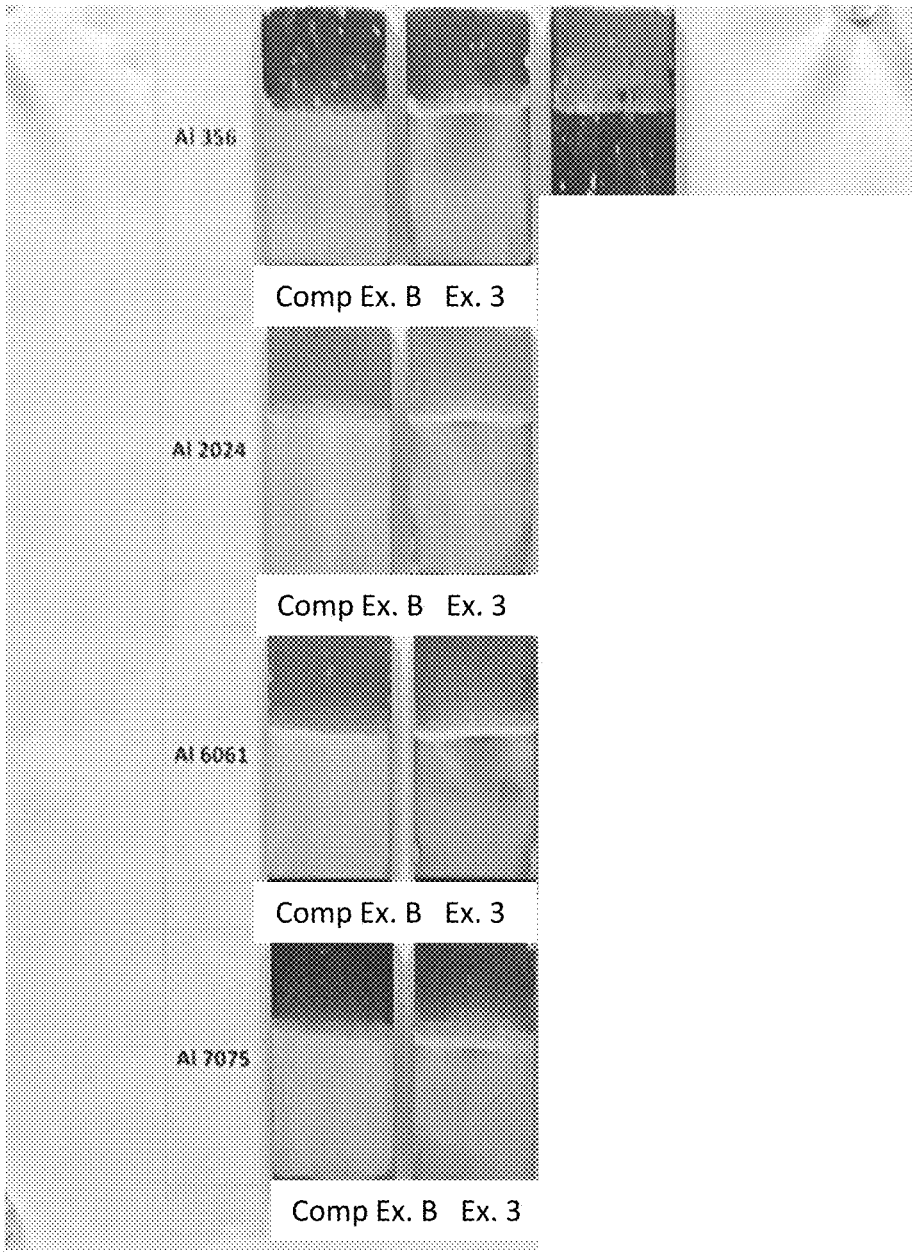
FIG. 2 are photographs depicting four types of aluminum panels exposed to various inventive solutions to show the resulting improvement in metal staining relative to FIG. 1.

The process of Example 2 is repeated with Comparative Example B failing while Example 3 passed, as shown in FIG. 2.

Example 5

The solutions of Examples 1 and 3 and Comparative Examples A and B are subjected to biological testing according to ASTM E2275. Superior results as to either passing microbial testing and/or reduced substrate staining is noted for the inventive examples relative to the comparative examples.

Example 6

A solution is prepared with 30.0 total weight percent of 3-amino-4-octanol, 25.0 total weight percent of an equimolar amounts of sebacic acid, undecanedioic acid and dodecanedioic acid, and the remainder being water. The resulting solution greatly exceeded the solubility of 3-amino-4-octanol at standard temperature and pressure (STP) of about 4.5 percent by weight in water and passed testing per Example 5 of more than 30 weeks.

Example 7

1.2 parts by weight of 3-amino-4-octanol is added to 1 part by weight of sebacic acid in water until dissolved. The typical solubility of 3-amino-4-octanol is less than 4.5 percent. Through this stepwise dissolution, 3-amino-4-octanol is dissolved to amounts in excess of 35% total weight percent. 3-amino-4-octanol in solution at 6 total weight percent at higher is correlated with enhanced resistant to microbial growth, and superior ferrous and aluminum corrosion protection.

Example 8

The process of Example 7 is repeated with an acid group stoichiometrically equivalent amount of polyacrylic acid with an average molecular weight of 2,500 relative to sebacic acid. Similar results are obtained.

Example 9

The process of Example 8 is repeated with an acid group stoichiometrically equivalent amount of polymethylpropane sulfonic acid with an average molecular weight of 3,000 relative to polyacrylic acid. Similar results are obtained.

While particular embodiments have been described, alternatives, modifications, variations, improvements, and substantial equivalents that are or may be presently unforeseen may arise to applicants or others skilled in the art. Accordingly, the appended claims as filed and as they may be amended, are intended to embrace all such alternatives, modifications variations, improvements, and substantial equivalents.

The invention claimed is:

1. An aqueous solution comprising:

an alkylated amine, wherein said alkylated amine is one or more of: triethanolamine, 2-(diethylamino) ethanethiol, captamine, diethylethanolamine, methylcysteamine, 2-(tert-butylamino) ethanethiol, 2,2'-dimethoxy-1,1-dimethyl-dimethylamine, 3-amino-4-octanol, 3-butoxypropylamine, N-acetylcysteamine, homocysteamine, N, N-dimethylhydroxylamine, 2-(isopropylamino) ethanol, 2-(methylthioethyl) amine, 1-aminopropane-2-thiol, leucinol, cysteamine, N,O-dimethylhydroxylamine, or a combination thereof; and at least two polyacids comprising undecanedioic acid and dodecanedioic acid present in amounts such that said alkylated amine exceeds a solubility of said alkylated amine in pure water at standard temperature and pressure (STP) and in the form of the aqueous solution and with the provisos that if a lubricity additive is present, said lubricity additive is selected from the group consisting of: graft copolymers, polyalkylene glycols, sulfonated polyvinylstyrene, poly (acrylic/styrene) copolymer; polyvinylpyrrolidone and its copolymers; polyoxazolines; and salts of polyamino carboxylic acid, alkyl aryl sulfonate; fatty acid salts, alkoxylated fatty amines, alkoxylated fatty alcohols, ether carboxylic acids and its salts, lecithin phosphorus containing compounds, sulfonic acid ester of plant oils, and combinations thereof;

a biocide; and if a corrosion inhibitor is present, said corrosion inhibitor is selected from the group consisting of: $C_6$-$C_{12}$ carboxylic acids, organically modified zinc aluminum molybdenum orthophosphate hydrate, zinc-5-nitroisophthalate, calcium borosilicate; a zinc salt of a benzoic acid, alkaline earth metal phosphate, zinc-barium phosphate, zinc phosphate, benzotriazole, tolytriazol, or combinations thereof.

2. The aqueous solution of claim 1 further comprising a pH adjustment agent to result in a pH of between 7 and 9.

3. The aqueous solution of claim 1 wherein said alkylated amine is 3-amino-4-octanol and said solubility is about 4.5 percent.

4. The aqueous solution of claim 3 wherein said alkylated amine is present at 30 total weight percent of the solution.

5. The aqueous solution of claim 1 wherein said alkylated amine comprises at least two types of alkylated amines.

6. The aqueous solution of claim 3 wherein said 3-amino-4-octanol is present from 6 to 30 total weight percent.

7. The aqueous solution of claim 3 wherein said 3-amino-4-octanol is present at more than 6 total weight percent and said at least two polyacids further comprises sebacic acid.

8. The aqueous solution of claim 1 further comprising at least one of a metal deactivator, a corrosion inhibitor, an antimicrobial agent, an anticorrosion agent, an extreme pressure agent, an antirust agent, an antioxidant, a chelating agent, a polymer, an anti-wear agent, or a combination thereof.

9. The aqueous solution of claim 8 wherein said anticorrosion agent is present and comprises a phosphate.

10. The aqueous solution of claim 1 further comprising a wear-indicating agent.

11. A method of metalworking comprising:

exposing a metal substrate to a solution of claim 1: and removing or displacing a portion of the metal substrate.

12. The method of claim 11 wherein the metal substrate is aluminum or an alloy thereof.

13. An aqueous solution consisting of:

at least one alkylated amine, wherein said alkylated amine is one or more of: triethanolamine, 2-(diethylamino) ethanethiol, captamine, diethylethanolamine, methylcysteamine, 2-(tert-butylamino) ethanethiol, 2,2'-dimethoxy-1,1-dimethyl-dimethylamine, 3-amino-4-octanol, 3-butoxypropylamine, N-acetylcysteamine, homocysteamine, N, N-dimethylhydroxylamine, 2-(isopropylamino) ethanol, 2-(methylthioethyl) amine, 1-aminopropane-2-thiol, leucinol, cysteamine, N,O-dimethylhydroxylamine, or a combination thereof; and at least two polyacids comprising undecanedioic acid and dodecanedioic acid present in amounts such that said alkylated amine exceeds a solubility of said alkylated amine in pure water at standard temperature and pressure (STP) and in the form of the aqueous solution and with the provisos that if a lubricity additive is present, said lubricity additive is selected from the group consisting of: graft copolymers, polyalkylene glycols, sulfonated polyvinylstyrene, poly (acrylic/styrene) copolymer; polyvinylpyrrolidone and its copolymers; polyoxazolines; and salts of polyamino carboxylic acid, alkyl aryl sulfonate; fatty acid salts, alkoxylated fatty amines, alkoxylated fatty alcohols, ether carboxylic acids and its salts, lecithin phosphorus containing compounds, sulfonic acid ester of plant oils, and combinations thereof;

a biocide;

optionally a metal deactivator, a corrosion inhibitor, an antimicrobial agent, an anticorrosion agent, an extreme pressure agent, an antirust agent, an antioxidant, a polymer, an anti-wear agent, or a combination thereof; and if a corrosion inhibitor is present, said corrosion inhibitor is selected from the group consisting of: $C_6$-$C_{12}$ carboxylic acids, organically modified zinc aluminum molybdenum orthophosphate hydrate, zinc-5-nitroisophthalate, calcium borosilicate; a zinc salt of a benzoic acid, alkaline earth metal phosphate, zinc-barium phosphate, zinc phosphate, benzotriazole, tolytriazol, or combinations thereof.

* * * * *